US008494671B2

(12) United States Patent
Akiyama et al.

(10) Patent No.: US 8,494,671 B2
(45) Date of Patent: Jul. 23, 2013

(54) GRINDING MACHINE HAVING THE FUNCTION OF MEASURING DISTANCE

(75) Inventors: Takanobu Akiyama, Numazu (JP); Hiroyuki Kakishima, Takata-Gun (JP)

(73) Assignee: Toshiba Kakai Kabushiki Kaisha, Tokyo (JP)

( * ) Notice: Subject to any disclaimer, the term of this patent is extended or adjusted under 35 U.S.C. 154(b) by 223 days.

(21) Appl. No.: 13/035,220

(22) Filed: Feb. 25, 2011

(65) Prior Publication Data

US 2011/0217905 A1 Sep. 8, 2011

(30) Foreign Application Priority Data

Mar. 5, 2010 (JP) ..... 2010-49407

(51) Int. Cl.

| | |
|---|---|
| ***G06F 19/00*** | (2006.01) |
| ***G01B 9/02*** | (2006.01) |
| ***G01B 11/02*** | (2006.01) |
| ***H04N 7/18*** | (2006.01) |
| ***G02B 7/04*** | (2006.01) |
| ***G05B 19/10*** | (2006.01) |
| ***G05B 19/29*** | (2006.01) |

(52) U.S. Cl.

USPC ..... 700/170; 700/193; 356/486; 356/496; 356/500; 348/79; 250/201.2; 318/567; 318/600

(58) Field of Classification Search

USPC ... 451/1, 5, 6, 41, 200, 285; 702/82; 356/486, 356/493, 496, 500; 348/79; 700/170, 193; 250/201.2, 201.3, 201.4; 318/567, 569, 600

See application file for complete search history.

(56) References Cited

U.S. PATENT DOCUMENTS

| | | | | |
|---|---|---|---|---|
| 5,741,171 | A * | 4/1998 | Sarfaty et al. | 451/6 |
| 6,533,641 | B1 * | 3/2003 | Morken et al. | 451/6 |
| 6,546,127 | B1 * | 4/2003 | Seong et al. | 382/152 |
| 6,570,156 | B1 * | 5/2003 | Tsuneta et al. | 250/311 |
| 8,160,738 | B2 * | 4/2012 | Nishikawa et al. | 700/195 |
| 2003/0201393 | A1 * | 10/2003 | Tsuneta et al. | 250/311 |
| 2004/0008878 | A1 * | 1/2004 | Kawashita | 382/141 |
| 2008/0002252 | A1 * | 1/2008 | Weiss et al. | 359/383 |
| 2009/0004828 | A1 * | 1/2009 | Kobayashi | 438/463 |
| 2010/0096550 | A1 * | 4/2010 | Yamazaki et al. | 250/310 |
| 2011/0217905 | A1 * | 9/2011 | Akiyama et al. | 451/5 |

* cited by examiner

*Primary Examiner* — Kavita Padmanabhan
*Assistant Examiner* — Darrin Dunn
(74) *Attorney, Agent, or Firm* — DLA Piper LLP (US)

(57) ABSTRACT

The invention relates to a grinding machine for grinding a workpiece, which has been set on a chuck top surface, by moving a rotating grinding wheel in relation to the workpiece. The grinding machine includes: a microscope configured to be vertically movable; a CCD camera configured to take an image viewed through the microscope; and an image processor configured to process the image taken by the CCD camera to measure a vertical distance between a reference plane of the microscope and an object of the microscope. The image processor is adapted to measure the vertical distance between the reference plane of the microscope and the object of the microscope based on sharpness of the image, which corresponds to how clear the microscope is focused.

5 Claims, 3 Drawing Sheets

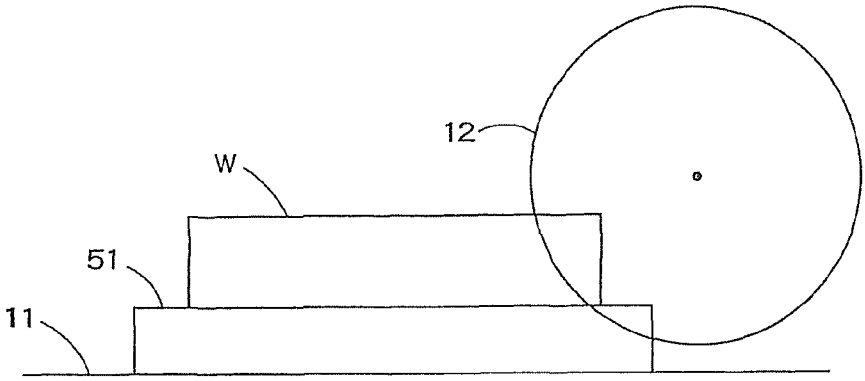
FIG. 3
SHIBAURA
FIG. 4
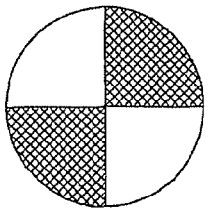
FIG. 5
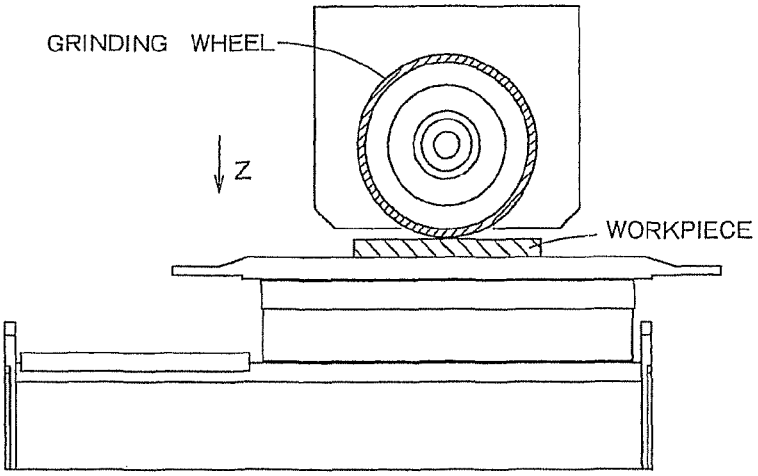
FIG. 6
PRIOR ART

GRINDING MACHINE HAVING THE FUNCTION OF MEASURING DISTANCE

CROSS REFERENCE TO RELATED APPLICATIONS

This application is based upon and claims the benefit of priority from the prior Japanese Patent Application No. 2010-49407 filed on Mar. 5, 2010, the entire contents of which are incorporated herein by reference.

FIELD OF THE INVENTION

The present invention relates to a grinding machine for grinding a workpiece, which is set on a chuck top surface, by moving a rotating grinding wheel in relation to the workpiece. More particularly, the present invention relates to a grinding machine having the function of measuring the vertical distance between a grinding wheel and a workpiece or the like.

BACKGROUND ART

There have widely been known grinding machines for grinding workpieces, which are set on respective chuck top surfaces, by moving rotating respective grinding wheels in relation to the workpieces. In such a conventional grinding machine, a very-slowly rotating grinding wheel is brought into contact with a workpiece by gradually lowering (along the Z-axis) the shaft of the grinding wheel manually, as shown in FIG. 6, and the point of contact of the grinding wheel with the workpiece is taken as zero point (whether or not the grinding wheel and the workpiece are in contact with each other is judged by the operator's feeling) for determining the relative coordinates of the grinding wheel and the workpiece. On the basis of the zero point, the depth of cut to be made in the workpiece, for example, is decided (set).

In another conventional grinding machine, a grinding wheel is brought into contact with a workpiece by gradually lowering (along the Z-axis) the shaft of the grinding wheel automatically with a predetermined voltage applied between the grinding wheel and the workpiece when the grinding wheel and the workpiece are electrically conductive, and the point of contact of the grinding wheel with the workpiece is taken as zero point (whether or not the grinding wheel and the workpiece are in contact with each other is judged by whether an electric current flows or not) for determining the relative coordinates of the grinding wheel and the workpiece.

SUMMARY OF THE INVENTION

The above-described manner that a grinding wheel is manually brought into contact with a workpiece, however, has a problem that the grinding wheel may damage the workpiece when it comes into contact with the workpiece. The aforementioned second manner that a grinding wheel is automatically brought into contact with a workpiece also has a problem that it can be used only when both the grinding wheel and the workpiece are electrically conductive.

The present invention was accomplished in light of the above problems in the conventional art. An object of the invention is therefore to provide a grinding machine having the function of measuring the vertical distance between a grinding wheel and a workpiece, which never damages a workpiece and which can also be used for a non-conductive workpiece.

The present invention is a grinding machine for grinding a workpiece, which has been set on a chuck top surface, by moving a rotating grinding wheel in relation to the workpiece, the grinding machine including: a microscope configured to be vertically movable; a CCD camera configured to take an image viewed through the microscope; and an image processor configured to process the image taken by the CCD camera to measure a vertical distance between a reference plane of the microscope and an object of the microscope; wherein the image processor is adapted to measure the vertical distance between the reference plane of the microscope and the object of the microscope based on sharpness of the image, which corresponds to how clear the microscope is focused.

According to the present invention, the vertical distance between the reference plane of the microscope and the object of the microscope is measured based on the images viewed through the microscope. The grinding machine of the invention, therefore, never damages a workpiece in the measurement of the vertical distance between the reference plane of the microscope and the workpiece, and it can be used even for non-conductive workpieces. Accordingly, it is possible to obtain the vertical distance between the grinding wheel and the workpiece from a relationship between the position of the grinding wheel and that of the reference plane of the microscope.

Similarly, in the measurement of the vertical distance between the reference plane of the microscope and the chuck top surface, the grinding machine of the invention never damages the chuck top surface, and it can be used even for chuck top surfaces having no electrical conductivity. Then, it is also possible to obtain the vertical distance between the grinding wheel and the chuck top surface from a relationship between the position of the grinding wheel and that of the reference plane of the microscope.

Preferably, the image processor is connected to an NC device, and the image processor is adapted to receive, from the NC device, coordinates of the reference plane of the microscope positioned at a point at which the vertical distance is being measured, to determine coordinates of the object of the microscope based on the coordinates of the reference plane of the microscope and the vertical distance that has been measured, and to send the coordinates of the object of the microscope to the NC device.

According to this manner, a process (a processing operation) for the workpiece by means of the NC device can be carried out more accurately and easily.

In this case, it is preferred that the NC device is connected to a drive controller for controlling vertical movement of the microscope and is adapted to control the drive controller.

In the above case, more preferably, the NC device causes the microscope to continuously move vertically via the drive controller, and the image processor is adapted to continuously receive at predetermined time intervals a plurality of images viewed through the vertically moving microscope and to specify an image with the highest degree of sharpness based on the sharpness of each image it received, thereby measuring the vertical distance between the reference plane of the microscope and the object of the microscope. According to this manner, the vertical distance between the reference plane of the microscope and the object of the microscope can be measured semi-automatically.

Alternatively, preferably, the NC device causes the microscope to roughly move vertically at least once via the drive controller; the image processor is adapted to continuously receive at predetermined time intervals a plurality of images viewed through the roughly vertically moving microscope and to specify an image with the highest degree of sharpness based on the sharpness of each image it received, thereby extracting a vertical region including the vertical position corresponding to the image with the highest degree of sharpness; the NC device next causes the microscope to finely move vertically at least once in the extracted vertical region via the drive controller; and the image processor is adapted to continuously receive at predetermined time intervals a plurality of images viewed through the finely vertically moving microscope and to specify an image with the highest degree of sharpness based on the sharpness of each image it received, thereby measuring the vertical distance between the reference plane of the microscope and the object of the microscope. According to this manner, the vertical distance between the reference plane of the microscope and the object of the microscope can be measured semi-automatically, accurately and quickly.

In addition, preferably, the microscope is fixed to a member supporting the grinding wheel at a rotational axis thereof and thus integrally moves along with the member. According to this manner, the vertical distance between the reference plane of the microscope and the object of the microscope can be directly converted to the vertical distance between the reference plane of the grinding wheel and the object of the microscope.

It is also preferable that the chuck top surface has a sharpness pattern useful for making it easier to evaluate the sharpness of the images. According to this manner, accuracy in evaluating the sharpness of the images viewed through the microscope can be improved, which leads to improvement in accuracy in measuring distance. The sharpness pattern herein means a pattern that makes it easier to judge whether the microscope is in focus or not (a pattern whose in-focus and out-focus images viewed through the microscope are greatly different from each other in sharpness). Specifically, it includes striped patterns, for example.

Alternatively, the present invention is a method for measuring a vertical distance between a reference plane of a microscope and an object of the microscope, applicable to a grinding machine for grinding a workpiece, which has been set on a chuck top surface, by moving a rotating grinding wheel in relation to the workpiece, the grinding machine including: a microscope configured to be vertically movable; and a CCD camera configured to take an image viewed through the microscope; the method for measuring the vertical distance comprising: processing the image taken by the CCD camera to measure a vertical distance between a reference plane of the microscope and an object of the microscope based on sharpness of the image, which corresponds to how clear the microscope is focused.

According to the present invention, the vertical distance between the reference plane of the microscope and the object of the microscope is measured based on the images viewed through the microscope. The grinding machine of the invention, therefore, never damages a workpiece in the measurement of the vertical distance between the reference plane of the microscope and the workpiece, and it can be used even for non-conductive workpieces. Accordingly, it is possible to obtain the vertical distance between the grinding wheel and the workpiece from a relationship between the position of the grinding wheel and that of the reference plane of the microscope.

Similarly, in the measurement of the vertical distance between the reference plane of the microscope and the chuck top surface, the grinding machine of the invention never damages the chuck top surface, and it can be used even for chuck top surfaces having no electrical conductivity. Then, it is also possible to obtain the vertical distance between the grinding wheel and the chuck top surface from a relationship between the position of the grinding wheel and that of the reference plane of the microscope.

Preferably, the microscope is vertically moved, a plurality of images viewed through the vertically moving microscope are continuously received at predetermined time intervals, and an image with the highest degree of sharpness is specified based on the sharpness of each image received, thereby measuring the vertical distance between the reference plane of the microscope and the object of the microscope. According to this manner, the vertical distance between the reference plane of the microscope and the object of the microscope can be measured semi-automatically.

Alternatively, preferably, the microscope is vertically moved; a plurality of images viewed through the vertically moving microscope during the first moving travel are continuously received at predetermined time intervals; an image with the highest degree of sharpness is specified based on the sharpness of each image received; a vertical region including the vertical position corresponding to the image with the highest degree of sharpness is extracted; a plurality of images viewed through the vertically moving microscope during the second moving travel for the extracted vertical region are continuously received at predetermined time intervals; and an image with the highest degree of sharpness is specified based on the sharpness of each image received, thereby measuring the vertical distance between the reference plane of the microscope and the object of the microscope. According to this manner, the vertical distance between the reference plane of the microscope and the object of the microscope can be measured semi-automatically, accurately and quickly.

Alternatively, the present invention is a method for producing data for controlling a process using a grinding machine, which is connected to an NC device and for grinding a workpiece, that has been set on a chuck top surface, by moving a rotating grinding wheel in relation to the workpiece, the grinding machine including: a microscope configured to be vertically movable; and a CCD camera configured to take an image viewed through the microscope; the method for producing date for controlling a process comprising: processing the image taken by the CCD camera to measure a vertical distance between a reference plane of the microscope and an object of the microscope based on sharpness of the image, which corresponds to how clear the microscope is focused; obtaining, from the NC device, coordinates of the reference plane of the microscope positioned at a point at which the vertical distance is being measured; determining coordinates of the object of the microscope based on the coordinates of the reference plane of the microscope and the vertical distance that has been measured; and sending the coordinates of the object of the microscope to the NC device.

Preferably, in the step of processing the image taken by the CCD camera, the microscope is vertically moved, a plurality of images viewed through the vertically moving microscope are continuously received at predetermined time intervals, and an image with the highest degree of sharpness is specified based on the sharpness of each image received, thereby measuring the vertical distance between the reference plane of the microscope and the object of the microscope.

Alternatively, preferably, in the step of processing the image taken by the CCD camera, the microscope is vertically moved; a plurality of images viewed through the vertically moving microscope during the first moving travel are continuously received at predetermined time intervals; an image with the highest degree of sharpness is specified based on the sharpness of each image received; a vertical region including the vertical position corresponding to the image with the highest degree of sharpness is extracted; a plurality of images viewed through the vertically moving microscope during the second moving travel for the extracted vertical region are continuously received at predetermined time intervals; an image with the highest degree of sharpness is specified based on the sharpness of each image received, thereby measuring the vertical distance between the reference plane of the microscope and the object of the microscope.

BRIEF DESCRIPTION OF THE DRAWINGS

FIG. 3 is a diagrammatic sectional view for explaining a dicing tape;

FIG. 4 illustrates an example of sharpness pattern;

FIG. 5 illustrates another example of sharpness pattern; and

FIG. 6 is a diagrammatic view for explaining the detection of zero point in the conventional art.

DETAILED DESCRIPTION OF THE INVENTION

With reference to the accompanying drawings, an embodiment of the present invention will be described hereinafter.

Figure 1:
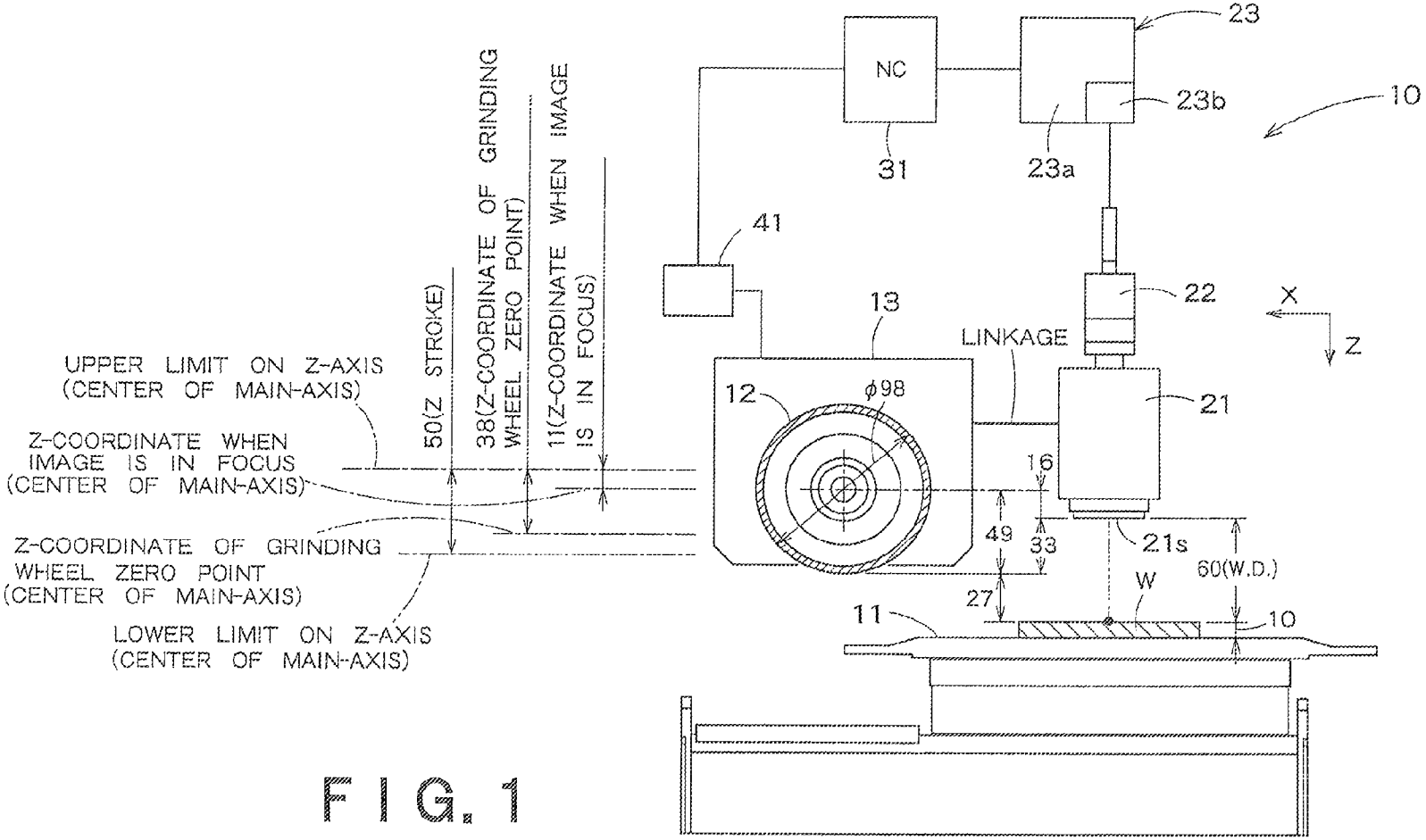
FIG. 1 is a diagrammatic view of a grinding machine having the function of measuring a vertical distance between a reference plane of a microscope and an object of the microscope according to an embodiment of the present invention.

FIG. 1 is a diagrammatic view of a grinding machine having the function of measuring a vertical distance between a reference plane of a microscope and an object of the microscope according to an embodiment of the present invention. As shown in FIG. 1, a grinding machine 10 according to this embodiment includes a chuck top surface 11, on which a workpiece W is to be set. The chuck top surface 11 is movable in the X direction (the right-and-left direction on the plane of FIG. 1) and in the Y direction (in the direction vertical to the plane of FIG. 1) within the same horizontal level. Moreover, the top chuck surface 11 is rotatable around a rotational axis thereof, not shown in FIG. 1, on the X-Y plane (the top chuck surface 11 has the degree of freedom "R").

The grinding machine 10 according to this embodiment comprises a rotating grinding wheel 12, and thus the grinding machine 10 can grind a workpiece W by moving the axis of rotation of the rotating grinding wheel 12 relative to the workpiece W.

The grinding machine 10 according to this embodiment has a microscope 21 that is vertically movable. A CCD camera 22 is connected to the microscope 21 to take an image viewed through the microscope 21. An image processor 23 is connected to the CCD camera 22, to process the images taken by the CCD camera 22 to measure the vertical distance between the reference plane 21*s* of the microscope 21 and the object of the microscope 21, which is herein the top surface of the workpiece W.

The microscope 21 is a telecentric optical microscope, which is characterized by a great inherent working distance (W.D.). Further, the microscope 21 has an automatic-focusing system with which it can be automatically focused at its inherent depth of field.

In this embodiment, the image processor 23 has a panel PC 23*a* and an image-input board 23*b*. The images taken by the CCD camera 22 are put into the panel PC 23*a* through the image-input board 23*b*, and the panel PC 23*a* executes various processing operations on the images. Specifically, with the aid of a program for image processing, the panel PC 23*a* evaluates the sharpness of each image it received. The sharpness of an image is a parameter as to how clear the microscope is focused, for example, as to whether the image is in focus or not. It is known by those skilled in the art that the sharpness can be evaluated, for example, based on absolute difference between an image and another image slightly offset to the right-, left-, up- or down-side from the former image, or based on correlation coefficients between the two images. In this embodiment, the sharpness of each image viewed through the microscope 21 is evaluated. When the microscope 21 is in such a position that it provides an image with the highest degree of sharpness, the distance between the reference plane of the microscope 21 and the object of the microscope 21 (which is herein the top surface of the workpiece W) conforms with the inherent working distance (W.D.) of the microscope 21. Namely, when the microscope 21 is in this position on the vertical axis, the panel PC 23*a* measures (recognizes) the vertical distance between the reference plane 21*s* of the microscope 21 and the top surface of the workpiece W as the inherent working distance (W.D.) of the microscope 21.

The image processor 23 in this embodiment is connected to an NC device 31 and is adapted to receive coordinates of the reference plane of the microscope 21 from the NC device 31. And then, the image processor 23 is adapted to determine coordinates of the top surface of the workpiece W on the basis of the coordinates of the reference plane 21*s* of the microscope 21 and the vertical distance that has been measured as described above (the inherent working distance (W.D.) of the microscope 21). And then, the image processor 23 is adapted to send the coordinates of the top surface of the workpiece W to the NC device 31.

The microscope 21 in this embodiment is fixed (at least with regard to the Z direction) to a fixing member 13 rotationally supporting the rotational axis (main axis) of the grinding wheel 12 and is adapted to integrally move together with the fixing member 13 in the vertical direction. Therefore, the vertical distance between the reference plane 21*s* of the microscope 21 and the top surface of the workpiece W can be directly converted to the vertical distance between the reference plane (e.g., the lower limit) of the grinding wheel 12 and the top surface of the workpiece W.

The NC device 31 is connected to a drive controller 41 that controls the vertical movement of the fixing member 13 rotationally supporting the rotational axis (main axis) of the grinding wheel 12 and the microscope 21, and is adapted to control the drive controller 41.

Specifically, the NC device 31 is adapted to cause the fixing member 13 and the microscope 21 to continuously move vertically via the drive controller 41. The image processor 23 is adapted to continuously receive at predetermined time intervals a plurality of images viewed through the vertically moving microscope 21 and to specify an image with the highest degree of sharpness based on the sharpness of each image it received, thereby measuring the vertical distance between the reference plane 21*s* of the microscope 21 and the top surface of the workpiece W. Specifically, the vertical distance between the reference plane 21*s* of the microscope 21 and the top surface of the workpiece W is measured as the inherent working distance (W.D.) of the microscope 21, when the microscope 21 is in the position where it provides an image with the highest degree of sharpness.

An operation of the aforementioned embodiment will be described hereinafter.

Being under a control of the NC device 31, the fixing member 13 rotationally supporting the rotational axis (main axis) of the grinding wheel 12 and the microscope 21 are first moved (scanned) vertically via the drive controller 41. During this vertical movement travel, a plurality of images viewed through the microscope 21 is continuously put in the image processor 23 through the CCD camera 22 at predetermined time intervals. By means of an image-processing program named "COGNEX", the image processor 23 processes the images it received in order to evaluate the sharpness of each image, which is a parameter as to how clear the microscope 21 is focused, for example, as to whether each image is in focus or not. Thereafter, the image processor 23 specifies the image with the highest degree of sharpness, thereby measuring the vertical distance between the reference plane 21*s* of the microscope 21 and the top surface of the workpiece W. Specifically, when the vertically moving microscope 21 is in the position where it provides an image with the highest degree of sharpness, the vertical distance between the reference plane 21*s* of the microscope 21 and the top surface of the workpiece W is determined (measured) as the inherent working distance (W.D.) of the microscope 21.

Subsequently, the image processor 23 receives, from the NC device 31, coordinates of the reference plane 21*s* of the microscope 21 positioned at the above point at which the vertical distance has been measured. Then, the image processor 23 determines coordinates of the top surface of the workpiece W based on the coordinates of the reference plane 21*s* of the microscope 21 and the vertical distance that has been measured (the inherent working distance (D.C.) of the microscope 21). Furthermore, the image processor 23 sends the coordinates of the top surface of the workpiece W to the NC device 31. Thus, the data (values of the coordinates) useful for controlling a NC process can be automatically produced.

As mentioned above, according to the above embodiment, the vertical distance between the reference plane 21*s* of the microscope 21 and the top surface of the workpiece W is measured on the basis of the images viewed through the microscope 21. Therefore, there is no possibility that the workpiece W might be damaged. Besides, the present invention can also be used for any non-conductive workpiece. It is also possible to obtain the vertical distance between the grinding wheel 12 and the workpiece W from the relationship between the position of the grinding wheel 12 and that of the reference plane 21*s* of the microscope 21.

Particularly, the microscope 21 is caused to move (scan) vertically via drive controller 41, and the vertical distance between the reference plane 21*s* of the microscope 21 which is in the position where it provides an image with the highest degree of sharpness and the top surface of the workpiece W is measured. Thus, it is possible to make the measurement of the vertical distance semi-automatically.

Numerical examples are as follows. For example, as for the positional relationship between the center of the main axis of the grinding wheel 12 and the reference plane 21*s* of the microscope 21, when the offset in the Z-axis direction (the vertical direction in FIG. 1) is −16 mm (fixed value), and the radius of the grinding wheel 12 is 49 mm (which is changeable by replacement of the grinding wheel 12), the face-face gap in the Z-axis direction (the vertical direction in FIG. 1) between the working side (lower surface) of the grinding wheel 12 and the reference plane 21*s* of the microscope 21 is 33 mm. When the working distance (W.D.) of the microscope 21 is 60 mm, and the position of the microscope (on the Z-axis) where the microscope provides an image with the highest degree of sharpness, which is viewed (obtained) when the vertical distance between the reference plane of the microscope and the top surface of the workpiece is equal to the working distance, is +11 mm, the following value $$(+11)+60-(33)=+38 \text{ (mm)}$$

corresponds to the target position on the Z-axis of the grinding wheel 12, to which the grinding wheel 12 is moved via the drive controller 41 to come in contact with the workpiece W on the Z-axis. The following is the generalization thereof:

(the position of a microscope on the Z-axis)+(W.D. of the microscope)−(the gap between the reference plane of the microscope and the working side of a grinding wheel).

The image processor 23 executes the above processing (mathematical operation), and the position (coordinates) on the Z-axis of the grinding wheel 12 as obtained above is sent to the NC device 31. The NC device 31 can suitably set a depth of cut or the like, according to the coordinates. Thus, any desired machining process can be achieved.

Figure 2:
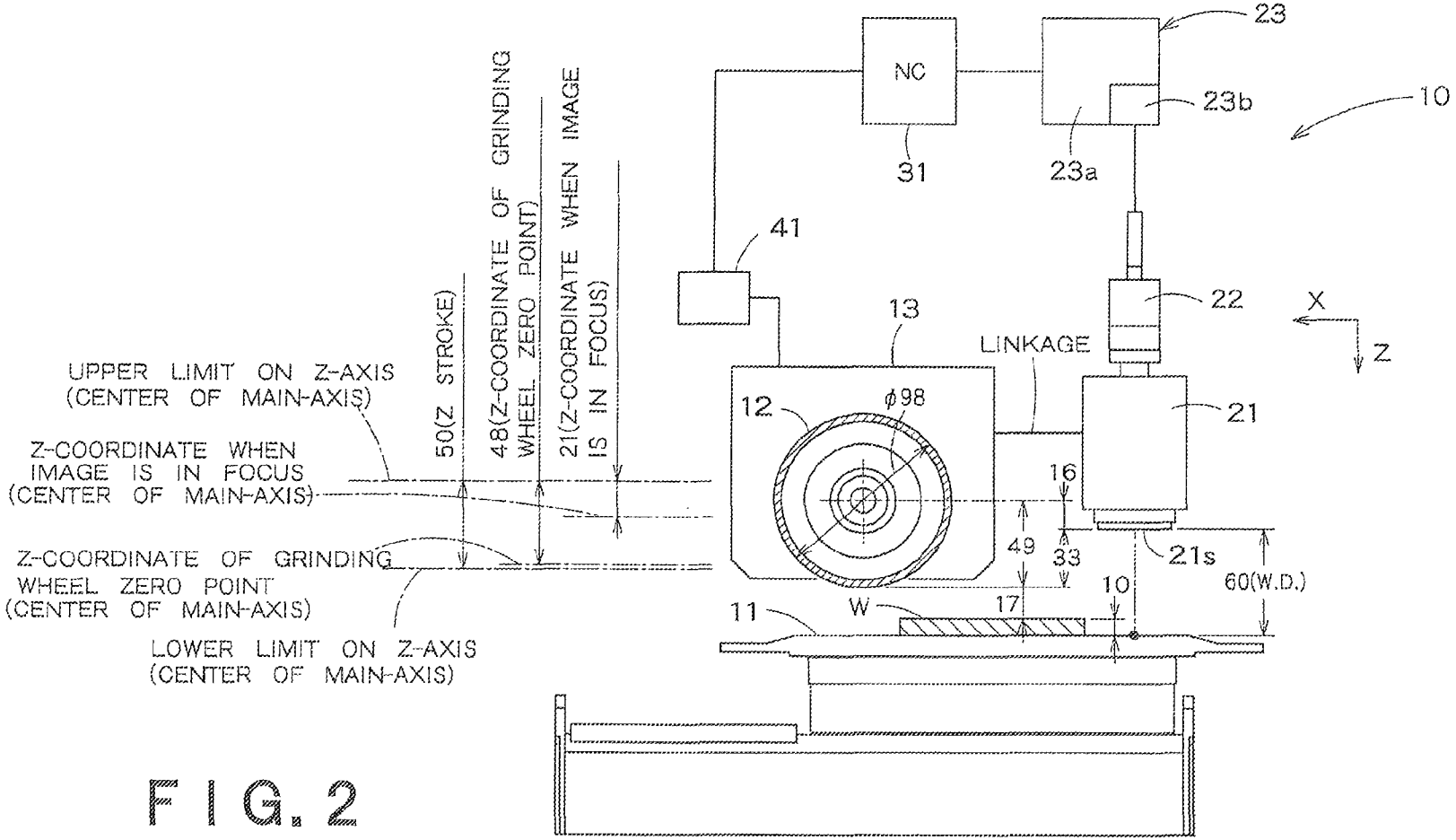
FIG. 2 is another diagrammatic view of the grinding machine shown in FIG. 1, wherein a chuck top surface is the object of the microscope.

Furthermore, according to the grinding machine 10 of this embodiment, there can also be obtained the position (coordinates) on the Z-axis of the grinding wheel 12 where the grinding wheel 12 comes in contact with not the top surface of the workpiece W but the chuck top surface 11, for example. This will be explained with reference to FIG. 2. When the chuck top surface 11 is taken as the object of observation, if the position of the microscope (on the Z-axis) at which it provides an image with the highest degree of sharpness, which is viewed (obtained) when the vertical distance between the reference plane of the microscope and the chuck top surface is equal to the working distance, is +21 mm, the following value $$(+21)+60-(33)=+48 \text{ (mm)}$$

corresponds to the position on the Z-axis of the grinding wheel 12, to which the grinding wheel 12 is moved via the drive controller 41 to come in contact with the chuck top surface 11 on the Z-axis.

The image processor 23 executes the above processing (mathematical operation), and the position (coordinates) on the Z-axis of the grinding wheel 12 as obtained above is sent to the NC device 31. The NC device 31 can suitably set a depth of cut or the like, according to the coordinate. Thus, any desired machining process can be achieved.

Specifically, in the process of cutting, a dicing tape 51 is usually placed between the chuck top surface 11 and the workpiece W. As shown in FIG. 4, it is preferable that a depth of cut is set to about a half of the thickness of the dicing tape 51. If the depth of cut is so set, the possibility of damaging the chuck top surface 11 by error during the process of cutting can be significantly reduced. For example, when the thickness of the dicing tape 51 is 0.1 mm (the dicing tape 51 shown in FIG. 4 is exaggeratedly depicted in terms of its thickness to facilitate the understanding of the tape), it is preferable to set the control position, on the Z-axis, of the lower end of a processing blade to $$48-0.1/2=47.95 \text{ (mm)}.$$

It is, of course, possible to regard (treat) the top surface of the dicing tape 51 as the object of the microscope 21. The dicing tape is, for example, a pressure-sensitive adhesive tape to which a workpiece can be easily fixed and which loses its adhesiveness when exposed to UV light and releases the workpiece easily.

According to the inventor's finding, it is preferable that a sharpness pattern, which makes it easier to evaluate the sharpness of the image, is provided on the top surface of the object of the microscope 21, i.e., the chuck top surface 11 or the top surface of the workpiece W. The sharpness pattern herein means a pattern that makes it easier to judge whether the microscope is in focus or not (a pattern whose in-focus and out-focus images viewed through the microscope are greatly different from each other in sharpness). The sharpness pattern is typically a striped pattern, but not limited thereto. For example, the sharpness pattern may be a lettered mark as shown in FIG. 5, or a geometrical pattern as shown in FIG. 6. The use of such a sharpness pattern improves the accuracy in evaluating the sharpness of images viewed through the microscope 21, which leads to improvement in accuracy in measuring the vertical distance.

To obtain the coordinate data more accurately, vertical moving (scanning) of the microscope 21 is carried out preferably two times or more. Herein, it is preferable to cause the microscope 21 to move (scan) vertically two times or more in the following manner, rather that to move (scan) vertically two times or more simply in the same manner. That is, preferably, the NC device 31 causes the microscope 21 to roughly move vertically once via the drive controller 41; the image processor 23 continuously receives at predetermined time intervals a plurality of images viewed through the roughly vertically moving microscope 21 and to specify an image with the highest degree of sharpness based on the sharpness of each image it received, thereby extracting a vertical region including the vertical position corresponding to the image with the highest degree of sharpness; the NC device 31 next causes the microscope 21 to finely move vertically at least once in the extracted vertical region via the drive controller 41; and the image processor 23 continuously receives at predetermined time intervals a plurality of images viewed through the finely vertically moving microscope 21 and to specify an image with the highest degree of sharpness based on the sharpness of each image it received, thereby measuring the vertical distance between the reference plane 21*s* of the microscope 21 and the object of the microscope. According to this manner, the vertical distance between the reference 21*s* plane of the microscope 21 and the object of the microscope can be measured semi-automatically, accurately and quickly.

As for the depth of field of the microscope 21 for use in the present invention, the inventor experimentally confirmed that a smaller value is preferable. Specifically, the error in measurement of the vertical distance was from 20 to 30 μm when a microscope whose depth of field is 70 μm was used, while it was only about 5 μm when a microscope whose depth of field is 17 μm was used. Therefore, the use of a microscope with a smaller depth of field is recommendable for the grinding machine of the invention, especially if the grinding machine is required to provide higher accuracy for a machining process. Specifically, the depth of field is preferably in the order of 5 to 20 μm.

What is claimed is:

1. A grinding machine for grinding a workpiece, which has been set on a chuck top surface, by moving a rotating grinding wheel in relation to the workpiece, the grinding machine comprising:

a microscope configured to be vertically moveable;

a charge-coupled device (CCD) camera configured to take an image viewed through the microscope; and an image processor configured to process the image taken by the CCD camera to measure a vertical distance between a reference plane of the microscope and an object of the microscope; wherein the image processor is adapted to measure the vertical distance between the reference plane of the microscope and the object of the microscope based on sharpness of the image, which corresponds to how clear the microscope is focused, the image processor is connected to a numerical control (NC) device, the image processor is adapted to receive, from the NC device, coordinates of the reference plane of the microscope positioned at a point at which the vertical distance is being measured, to determine coordinates of the object of the microscope based on the coordinates of the reference plane of the microscope and the vertical distance that has been measured, and to send the coordinates of the object of the microscope to the NC device, the NC device is connected to a drive controller for controlling vertical movement of the microscope and is adapted to control the drive controller, the NC device causes the microscope to move vertically at least once via the drive controller, the image processor is adapted to continuously receive at predetermined time intervals a plurality of images viewed through the vertically moving microscope and to specify an image having a highest degree of sharpness based on the sharpness of each image it received, thereby extracting a vertical region including a vertical position corresponding to the image with the highest degree of sharpness, the NC device next causes the microscope to move vertically at least once in the extracted vertical region via the drive controller, and the image processor is adapted to continuously receive at predetermined time intervals a plurality of images viewed through the microscope moving vertically in the extracted vertical region and to specify an image having a highest degree of sharpness based on the sharpness of each image it received, thereby measuring the vertical distance between the reference plane of the microscope and the object of the microscope.

2. The grinding machine having the function of measuring distance according to claim 1, wherein the microscope is fixed to a member supporting the grinding wheel at a rotational axis thereof and thus integrally moves along with the member.

3. The grinding machine having the function of measuring distance according to claim 1, wherein the chuck top surface has a sharpness pattern to evaluate the sharpness of the images.

4. A method for measuring a vertical distance between a reference plane of a microscope and an object of the microscope, applicable to a grinding machine for grinding a workpiece, which has been set on a chuck top surface, by moving a rotating grinding wheel in relation to the workpiece, the grinding machine including: a microscope configured to be vertically movable; and a charge-coupled device (CCD) camera configured to take an image viewed through the microscope;

the method for measuring the vertical distance comprising:

processing the image taken by the CCD camera to measure a vertical distance between a reference plane of the microscope and an object of the microscope based on sharpness of the image, which corresponds to how clear the microscope is focused, wherein the microscope is vertically moved, a plurality of images viewed through the vertically moving microscope during a first moving travel are continuously received at predetermined time intervals, an image having a highest degree of sharpness is specified based on the sharpness of each image received;

a vertical region including a vertical position corresponding to the image with the highest degree of sharpness is extracted, a plurality of images viewed through the vertically moving microscope during a second moving travel for the extracted vertical region are continuously received at predetermined time intervals, and an image having a highest degree of sharpness is specified based on the sharpness of each image received, thereby measuring the vertical distance between the reference plane of the microscope and the object of the microscope.

5. A method for producing data for controlling a process using a grinding machine, which is connected to a numerical control (NC) device and for grinding a workpiece, that has been set on a chuck top surface, by moving a rotating grinding wheel in relation to the workpiece, the grinding machine including: a microscope configured to be vertically movable; and a charge-coupled device (CCD) camera configured to take an image viewed through the microscope; the method for producing date data for controlling a process comprising:

processing the image taken by the CCD camera to measure a vertical distance between a reference pane of the microscope and an object of the microscope based on sharpness of the image, which corresponds to how clear the microscope is focused, obtaining, from the NC device, coordinates of the reference plane of the microscope positioned at a point at which the vertical distance is being measured, determining coordinates of the object of the microscope based on the coordinates of the reference plane of the microscope and the vertical distance that has been measured; and sending the coordinates of the object of the microscope to the NC device, wherein in the step of processing the image taken by the CCD camera, the microscope is vertically moved, a plurality of images viewed through the vertically moving microscope during a first moving travel are continuously received at predetermined time intervals, an image having a highest degree of sharpness is specified based on the sharpness of each image received, a vertical region including a vertical position corresponding to the image with the highest degree of sharpness is extracted, a plurality of images viewed through the vertically moving microscope during a second moving travel for the extracted vertical region are continuously received at predetermined time intervals, and an image having a highest degree of sharpness is specified based on the sharpness of each image received, thereby measuring the vertical distance between the reference plane of the microscope and the object of the microscope.

* * * * *

UNITED STATES PATENT AND TRADEMARK OFFICE

CERTIFICATE OF CORRECTION

PATENT NO. : 8,494,671 B2
APPLICATION NO. : 13/035220
DATED : July 23, 2013
INVENTOR(S) : Takanobu Akiyama et al.

It is certified that error appears in the above-identified patent and that said Letters Patent is hereby corrected as shown below:

Title Page,

Item (73), delete "Toshiba Kakai Kabushiki Kaisha" and replace with --Toshiba Kikai Kabushiki Kaisha--

Signed and Sealed this
Sixth Day of May, 2014

Michelle K. Lee

Michelle K. Lee
*Deputy Director of the United States Patent and Trademark Office*